US007940952B2

(12) United States Patent
Regl

(10) Patent No.: US 7,940,952 B2
(45) Date of Patent: May 10, 2011

(54) ELECTRO-ACOUSTIC TRANSDUCER

(75) Inventor: Hans-Juergen Regl, Regensburg (DE)

(73) Assignee: Harman Becker Automotive Systems GmbH, Karlsbad (DE)

( * ) Notice: Subject to any disclaimer, the term of this patent is extended or adjusted under 35 U.S.C. 154(b) by 1463 days.

(21) Appl. No.: 11/340,415

(22) Filed: Jan. 26, 2006

(65) Prior Publication Data

US 2006/0177090 A1 Aug. 10, 2006

(30) Foreign Application Priority Data

Jan. 26, 2005 (EP) ..... 05001513

(51) Int. Cl.

| | |
|---|---|
| ***H04R 1/00*** | (2006.01) |
| ***H04R 9/06*** | (2006.01) |
| ***H04R 11/02*** | (2006.01) |
| *H04R 1/02* | (2006.01) |
| *H04R 1/20* | (2006.01) |

(52) U.S. Cl. ..... 381/399; 381/338; 381/408

(58) Field of Classification Search ..... 381/399
See application file for complete search history.

(56) References Cited

U.S. PATENT DOCUMENTS

| | | | | |
|---|---|---|---|---|
| 3,674,946 | A * | 7/1972 | Winey | 381/408 |
| 3,832,499 | A | 8/1974 | Heil | 179/115.5 |
| 3,873,784 | A * | 3/1975 | Doschek | 381/186 |
| 3,939,312 | A | 2/1976 | McKay | 179/115.5 |
| 4,484,037 | A | 11/1984 | Nieuwendijk | 179/115.5 |
| 4,924,504 | A | 5/1990 | Burton | 381/199 |
| 6,008,714 | A | 12/1999 | Okuda et al. | 336/200 |
| 2001/0048256 | A1 | 12/2001 | Miyazaki et al. | 310/81 |
| 2004/0170269 | A1 | 9/2004 | Madoch et al. | 379/221.15 |
| 2005/0175208 | A1 * | 8/2005 | Shaw et al. | 381/340 |

FOREIGN PATENT DOCUMENTS

| | | | | |
|---|---|---|---|---|
| DE | 1226647 | | 10/1966 | |
| DE | 2259815 | | 6/1973 | |
| DE | 3740918 | | 6/1988 | |
| FR | 2162380 | | 11/1972 | |
| GB | 2147768 | | 5/1985 | 9/2 |
| JP | 55001737 | | 1/1980 | |
| JP | 55068798 | | 5/1980 | |
| JP | 55068798 | A * | 5/1980 | |
| JP | 55147899 | | 11/1980 | |
| JP | 57054499 | | 3/1982 | |
| JP | 58119296 | A * | 7/1983 | |
| JP | 03262300 | | 11/1991 | |

* cited by examiner

*Primary Examiner* — Lana N Le
*Assistant Examiner* — Matthew Eason
(74) *Attorney, Agent, or Firm* — O'Shea Getz P.C.

(57) ABSTRACT

An electro-acoustic transducer includes a generally V-shaped diaphragm comprising a folded sheet of film material. The diaphragm also comprises two upper ends, a lower end, an inner surface, and an outer surface. A frame supports the diaphragm in at least the two upper ends of the diaphragm and a structured conductive layer is arranged on a surface of the diaphragm. Permanent magnets are attached to the frame adjacent to the upper two ends and the lower end of the diaphragm.

37 Claims, 6 Drawing Sheets

ELECTRO-ACOUSTIC TRANSDUCER

CLAIM OF PRIORITY

This patent application claims priority to European Patent Application serial number 05 001 513.0 filed on Jan. 26, 2005.

1. Field Of The Invention

The present invention relates generally to electro-acoustic transducers, and more particularly to electro-dynamic acoustic transducers.

2. Related Art

Conventional planar electro-acoustic transducers include a sound-generating diaphragm mounted within a frame. An electrical conductor pattern is applied to a surface of the diaphragm and receives electrical power from a suitable power source. Vibration of the diaphragm is induced by magnetic fields provided by a plurality of magnets that are mounted within the frame in opposing relationship to the electrical conductor pattern on one or opposite sides of the diaphragm.

U.S. Pat. No. 6,008,714 to Okuda discloses an electro-acoustic transducer including a permanent magnetic plate and a vibratory diaphragm disposed in opposing relation to the permanent magnetic plate. This prior art reference also discloses a resilient buffer member interposed between the vibratory diaphragm and the permanent magnetic plate, and a support member for regulating the position of the vibratory diaphragm relative to the permanent magnetic plate. The permanent magnetic plate is rigid and includes a parallel striped multipolar magnetized pattern and a plurality of air-discharge through-holes arranged in neutral zones of the magnetized pattern. The vibratory diaphragm is formed of a thin and soft resin film on which a coil is formed by printing. A linear portion of the conductor pattern is disposed in a position corresponding to the neutral zones of the permanent magnetic plate, and the vibratory diaphragm is supported such that the vibratory diaphragm can displace in a thickness-wise direction. The resilient buffer member is formed of generally same sized sheets as the vibratory diaphragm, which are soft and have high air-permeability. Due to the large radiating surface of the planar diaphragm, the transducers disclosed by Okuda show a highly directional behavior. In addition, such transducers comprise larger inhomogeneities of the magnet field reducing the efficiency of the transducer.

U.S. Pat. No. 3,832,499 to Heil discloses an electro-acoustic transducer in which a conductor is arranged in a meandering pattern on at least one side of a flexible diaphragm. The flexible diaphragm is pleated or corrugated such that when the diaphragm is placed in a magnetic field oriented in a front to rear axis, with electrical current flowing perpendicular to the magnetic field in one direction in a given fold and in an opposite direction in an adjacent fold, the adjacent folds are alternately displaced to the right and to the left along a third axis perpendicular to both the front to rear axis and to the direction of the electrical current. The air spaces between adjacent folds facing one side of the diaphragm are expanded while the air spaces on the other side are contracted, causing acoustic radiation to be propagated along the front to rear axis. The transducers disclosed by Heil have improved directivity but lower magnetic flux density due to inhomogeneities of the magnetic field.

U.S. Patent Application 2004/0170296A1 to Von Hellermann discloses an acoustical transducer with an array of spaced magnets that are oriented having their pole faces at an angle with respect to a plane defining a surface of a sound producing planar diaphragm on which a conductor pattern is arranged on at least one side of the planar diaphragm. Von Hellermann improves uniformity of the driving magnetic fields for the purpose of dramatically spreading the magnetic field distribution by an order of magnitude through providing larger gaps between the transducer diaphragm and the magnets. However, due to the large radiating surface of the planar diaphragm, the transducers disclosed by Von Hellermann show a highly directional behavior as well.

There is a need for a diaphragm transducer that provides relatively broad acoustical directivity of the diaphragm and substantially uniform magnetic flux perpendicular to the diaphragm.

SUMMARY OF THE INVENTION

An electro-acoustic transducer is provided having a generally v-shaped diaphragm comprising a folded sheet of film material, the v-shaped diaphragm comprising two upper ends, a lower end, an inner surface, and an outer surface. Due to the v-shape of the diaphragm the acoustic aperture is reduced to the effect that the directivity is broadened and thus improved.

The electro-acoustic transducer further comprises a frame for supporting the diaphragm in at least the two upper ends of the v-shaped diaphragm, a structured conductive layer arranged on at least one surface of the diaphragm, and permanent magnets attached to the frame in positions adjacent to the diaphragm, as for example two magnets adjacent to positions adjacent to the upper ends of the diaphragm, or three magnets adjacent to the upper ends and the lower end of the diaphragm. Due to relatively closed spaced magnets having their pole faces not parallel with respect to each other, the magnet field is very homogeneous. Thus, the efficiency of the transducer is improved.

The aperture width (i.e., distance of the two upper ends of the diaphragm) may be rather small to improve the directional behavior, but not as small as to create problems from unwanted compression and resonance effects.

The other systems, methods, features and advantages of the invention will be, or will become, apparent to one with skill in the art upon examination of the following figures and detailed description. It is intended that all such additional systems, methods, features and advantages be included within this description, be within the scope of the invention, and be protected by the following claims.

DESCRIPTION OF THE DRAWINGS

The invention can be better understood with reference to the following drawings and description. The components in the figures are not necessarily to scale, instead emphasis being placed upon illustrating the principles of the invention. Moreover, in the figures, like reference numerals designate corresponding parts. In the drawings.

DETAILED DESCRIPTION

Figure 1:
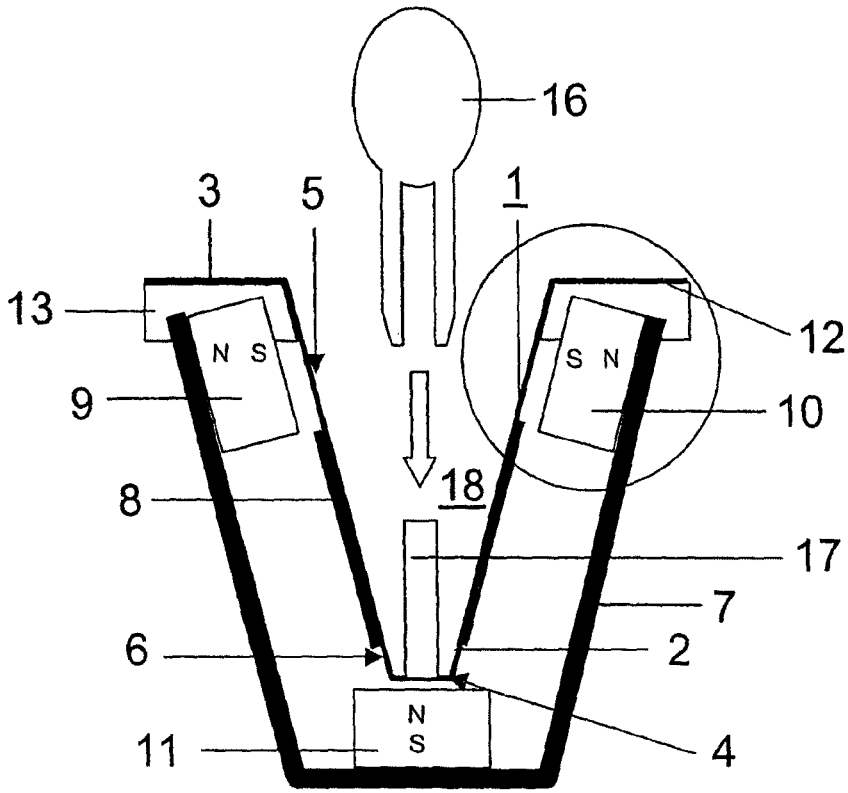
FIG. 1 is a cross sectional view of an electro-dynamic acoustic transducer having a phase-plug and a rectangular support element for the diaphragm.

FIG. 1 illustrates an electro-acoustic transducer having a generally v-shaped diaphragm 1 that comprises a folded (e.g., pleated) or curved sheet 2 of film material comprising polyethylene and/or polyethylene-naphthalate and/or polyimide. The transducer further comprises two upper ends 3, a lower end 4, an inner surface 5, and an outer surface 6. The diaphragm 1 is supported in at least its upper two ends 3 by a rigid frame 7 surrounding the diaphragm 1 on its outer surface 6. On the inner surface 5 and/or the outer surface 6, a structured conductive layer 8 is arranged representing a voice coil like circuit. The structured conductive layers 8 are connected to electrical terminals (not shown) to receive electrical input signals (not shown). Permanent magnets 9, 10, 11 are attached to the frame 7 in positions adjacent to the two upper ends 3 and the lower end 4 of the diaphragm 1.

The conductive layers 8 are arranged on the diaphragm 1 substantially in positions not adjacent to the magnets 9, 10, 11, which in the present embodiment is between those areas of the diaphragm adjacent to the magnets 9, 10, 11. The permanent magnets 9, 10, 11 are arranged in between the frame 7 and the outer surface 6 of the diaphragm 1. The permanent magnets 9, 10, 11 are preferably neodymium magnets and are arranged such that they generate opposing magnetic fields, for example the magnets 9, 10 at the upper end 3 of the diaphragm 1 have their South poles S facing the diaphragm 1 while magnet 11 at the lower end of the diaphragm 1 has its North pole N facing the diaphragm.

Figure 2:
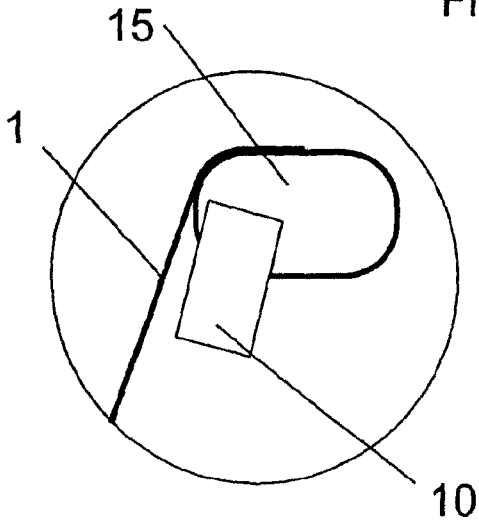
FIG. 2 is a cross sectional view of an alternative support element for the electro-dynamic acoustic transducer of FIG. 1, the support element having an external radius.
Figure 3:
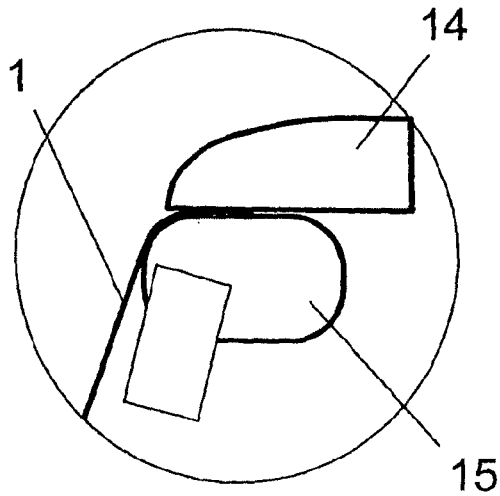
FIG. 3 is a cross sectional view of another alternative support element for the electro-dynamic acoustic transducer of FIG. 1, the support element having an external radius and holding clamps.

The diaphragm 1 may be fixed at its upper ends 3 by an adhesive 12 to a front element 13 having a substantially rectangular shape, where the front element 13 is attached to the frame 7 for providing sufficient locating surface for the diaphragm 1. Beside the shape of the front element 13 shown in FIG. 1, other forms are applicable as in particular a shape 15 having an external radius as can be seen from FIG. 2. Alternatively, holding clamps 14 as illustrated in FIG. 3 may be used for clamping the diaphragm 1 to the front element 13 at the two upper ends 3. The diaphragm 1 may be tensioned between the two upper ends 3 and the lower end 4.

A sound wave guiding element 16 for improved sound distribution is arranged in a position adjacent to the inner surface 5 of the diaphragm 1. In the transducer illustrated in FIG. 1, the sound wave guiding element 16 in connection with a pulling bolt 17 further provides the tension for the diaphragm 1 by pulling the diaphragm towards the magnet 11 at its lower end 4. The pulling bolt 17 extends from the lower part of the frame 7 (or alternatively from the magnet 11) through an orifice in the diaphragm 1 into a room surrounded by the inner side 5 of the diaphragm 1. The pulling bolt 17 may be elastic itself or attached elastically to the frame 7 or the magnet 11. The sound wave guiding element 16 may be mechanically bonded to the pulling bolt 17. Alternatively, the guiding element 16 may be for example snapped on, riveted on, shrunk on or screwed on the pulling bolt 17. The sound wave guiding element 16 and the pulling bolt 17 form a so-called phase plug.

Figure 4:
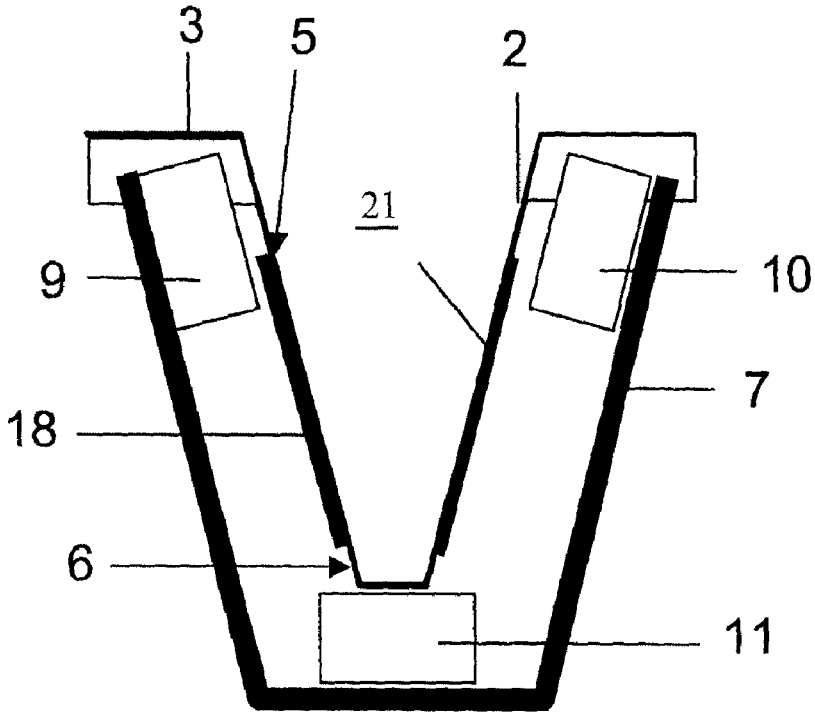
FIG. 4 is a cross sectional view of an alternative embodiment electro-dynamic acoustic transducer having a structured conductive layer arranged between the magnets.

The transducer of FIG. 4 is similar to the one shown in FIG. 1 but has no phase plug and no second conductive layer on the inner surface 5 of a diaphragm 21. The only conductive layer 18 is arranged on the diaphragm 21 substantially in positions non-adjacent to the magnets 9, 10, 11 which is mainly between those areas of the diaphragm 21 adjacent to the magnets 9, 10, 11 having only little overlap with the magnets 9 and 10, and having a certain distance to magnet 11.

Figure 5:
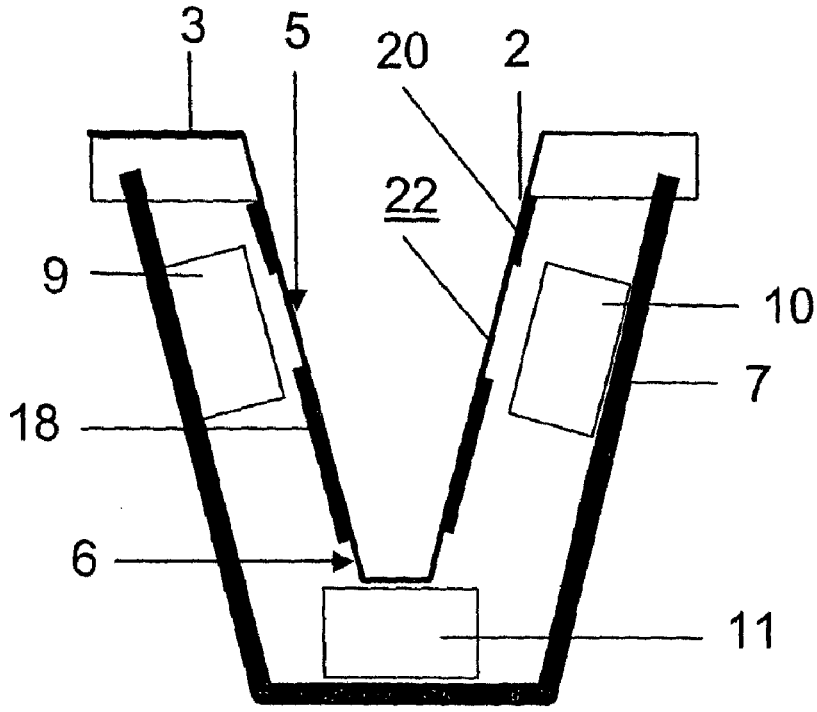
FIG. 5 is a cross sectional view of yet another alternative embodiment electro-dynamic acoustic transducer, which includes an additional structured conductive layer arranged between the magnets and at the upper ends of the diaphragm.

The transducer of FIG. 5 is similar to the one shown in FIG. 4 but has an additional structure 20 of the conductive layer 18 between the positions adjacent to the magnets 9 and 10 on one hand and the upper ends 3 of a diaphragm 22 on the other hand having only little overlap with the magnets 9 and 10. The diaphragms 1, 21, and 22 as illustrated in FIGS. 1, 4, and 5, respectively, comprise two edges with a flat bottom area in between at the lower end 4 of the respective diaphragm.

Figure 6:
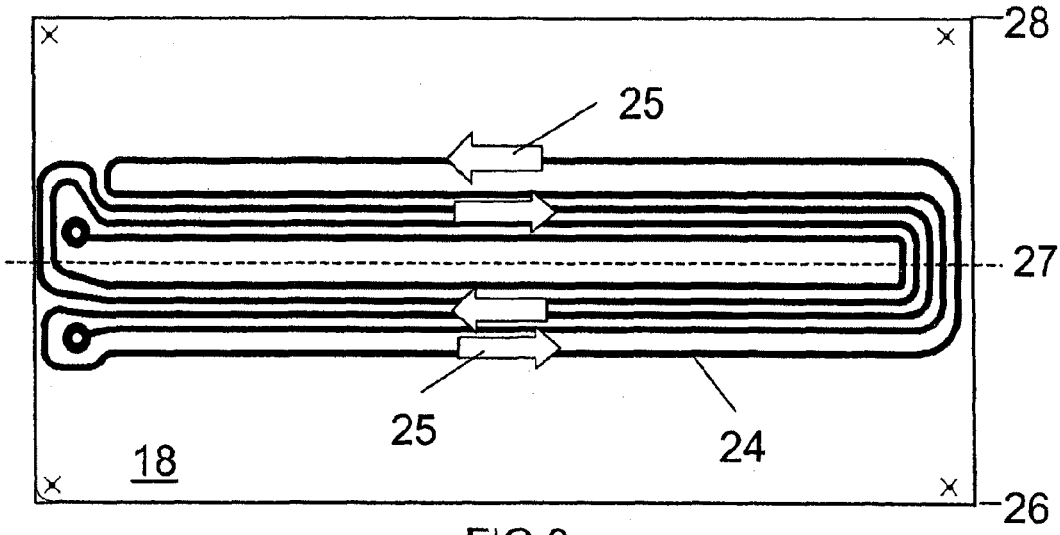
FIG. 6 is a cross sectional view of a diaphragm having structured layer.

FIG. 6 is a top view of the non-folded diaphragm 21 of FIG. 4 illustrating the conductive layer 18 on the outer surface 6 of the diaphragm 21. The structured conductive layer 18 may be made from aluminum or an aluminum comprising alloy. Although other materials, such as for example copper and copper alloys, are applicable, aluminum and its alloys are preferred because of their relatively low weight and excellent electrical conductivity versus mass ratio. The structured conductive layer 18 is arranged in a meandering pattern 24 where currents 25 in adjacent lines of the pattern 24 flow in directions that provide a uniform force direction onto the membrane. In FIG. 6, the meandering pattern 24 is arranged in two groups on each half of the diaphragm 21 forming a so-called butterfly pattern. The diaphragm 21 further comprises a carrier 4 which is, in the present case, a sheet of polyethylene-naphthalate (PEN) film material. Dotted line 27 indicates the lower end and lines 26, 28 indicate the upper ends of the diaphragm when folded. Although the structure illustrated above is preferred, other structures and in particular meandering structures such as for example accordion-like structures are applicable as well.

Figure 7:
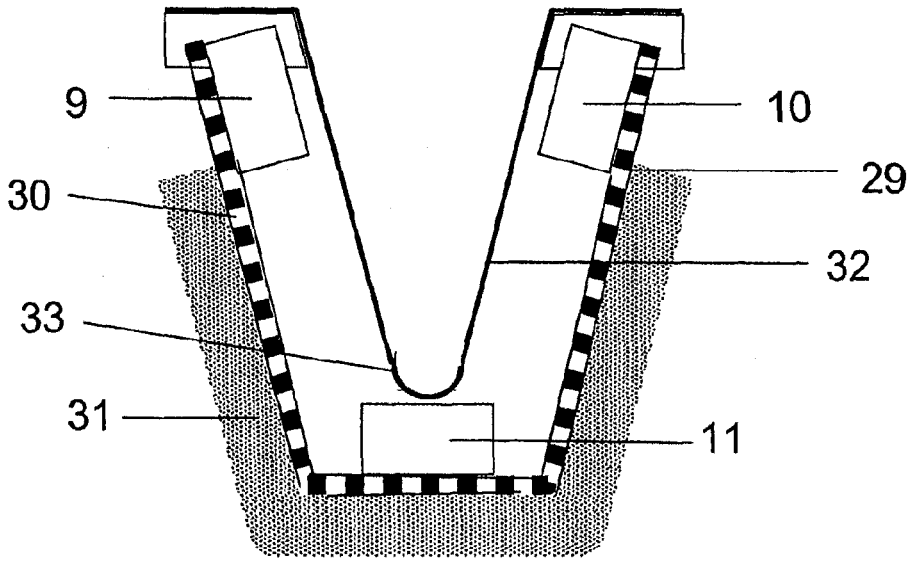
FIG. 7 is a cross sectional view of another alternative embodiment electro-dynamic acoustic transducer, which includes a vented frame.

The transducers illustrated in FIGS. 1, 4 and 5 each comprise a frame with a cup-like shape forming a closed volume in connection with the diaphragm while the transducer shown in FIG. 7 has a frame 29 with orifices 30 that are covered by an acoustically damping layer 31 such as, for example, felt material, foamed plastic, cellular plastic, etc. In contrast to the diaphragms shown in FIGS. 1, 4 and 5, diaphragm 32 of FIG. 7 has a curved lower end 33 with no edges.

Figure 8:
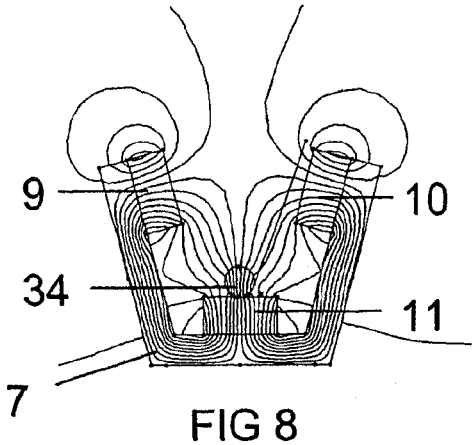
FIG. 8 is a cross sectional view of another alternative embodiment electro-dynamic acoustic transducer, which includes a soft-magnetic element for focusing magnetic flux.

FIG. 8 is a cross sectional view of an electro-dynamic acoustic transducer having a soft-magnetic element 34 for focusing magnetic flux. The soft-magnetic element 34 is, for example, a ferromagnetic, such as for example a steel rod or any other soft-magnet adapted to focus magnetic flux.

Figure 9:
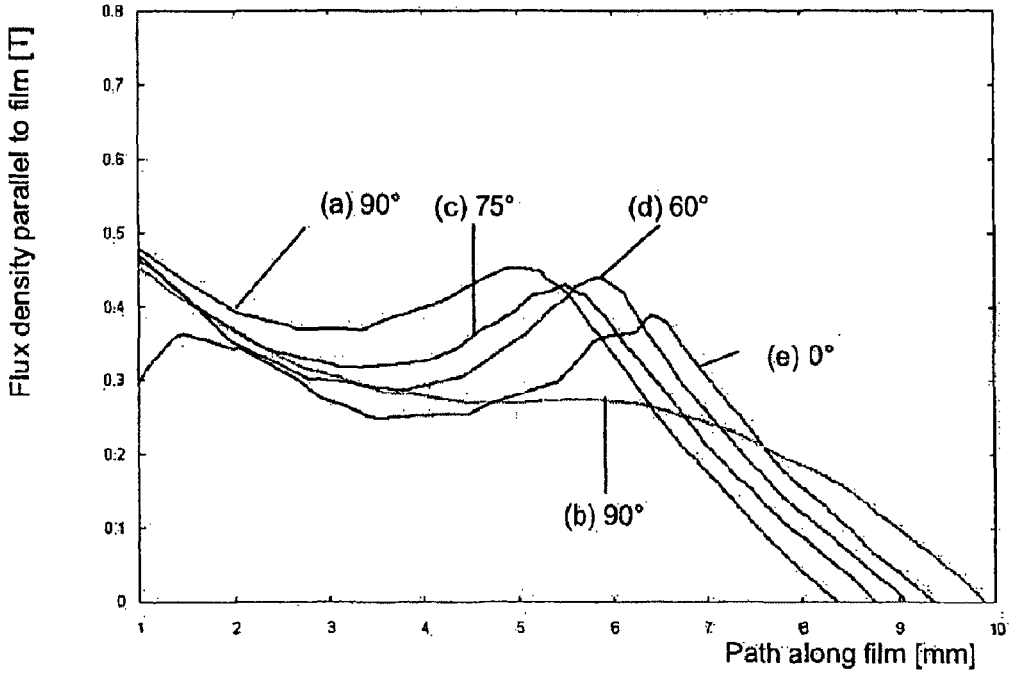
FIG. 9 is a diagram illustrating the difference in magnet flux of a transducer having different magnet angles.

FIG. 9 is a graphical illustration of the magnetic flux behavior of the electro-dynamic planar transducers of FIG. 1 and FIGS. 11 to 15, having different motor angles.

The aperture width should be small to improve directional behavior, on the other hand building a very narrow V-gap expectably leads to problems like compression and resonance effects and complicates the transducer design (e.g., phase plug structure, membrane carrier, mechanical tolerances) due to the limited space. A good target value for the width is around 12 to 15 mm (i.e., smaller than a 19 mm dome for good directivity)

Figure 10:
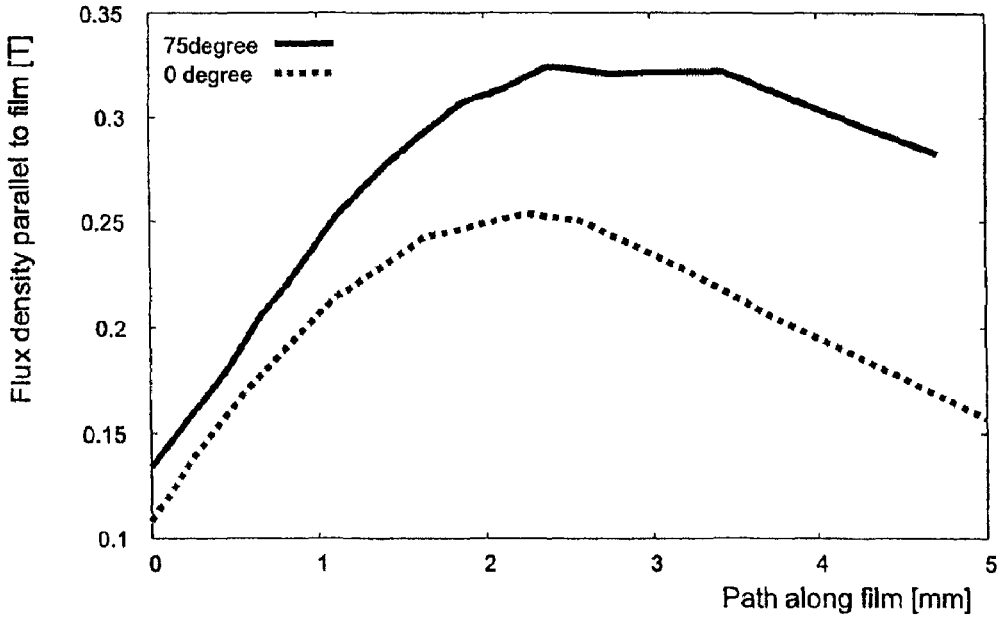
FIG. 10 is a diagram illustrating the variation of the flux density along the moving direction of the membrane.

The results of a magnetic flux analysis (e.g., magnetic flux density B) in dependence of different shaping angles are shown in FIG. 9. The best compromise between aperture width W and driving force distribution out of the flux density graph turned out to be at an opening angle, that is a motor angle, between 60 and 80 degrees and in particular around 75 degrees which effects maximum force in the plane of the tensioned membrane sections. A closer look onto the flux density B in FIG. 10 shows that the variation of the flux density B along the moving direction of the membrane (e.g., perpendicular to film plane) is smaller (i.e., flatter graph) than in known planar arrangements. This decreases harmonic distortions.

Figure 11:
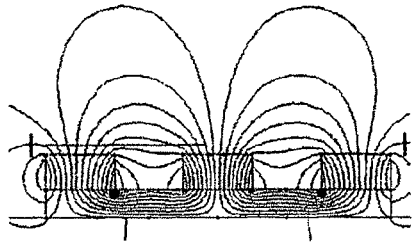
FIG. 11 is a cross sectional view of a motor system of a prior art electro-dynamic planar loudspeaker (EDPL) and the magnet flux behavior of the motor system.
Figure 12:
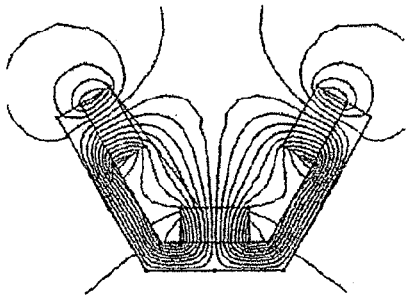
FIG. 12 is a cross sectional view and the magnetic flux behavior of the motor system of an electro-dynamic planar transducer having an opening angle of 60 degrees and a aperture width of 15 mm.
Figure 13:
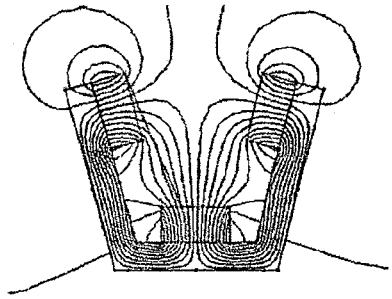
FIG. 13 is a cross sectional view and the magnetic flux behavior of the motor system of an electro-dynamic planar transducer having an opening angle of 75 degrees and a aperture width of 10 mm.
Figure 14:
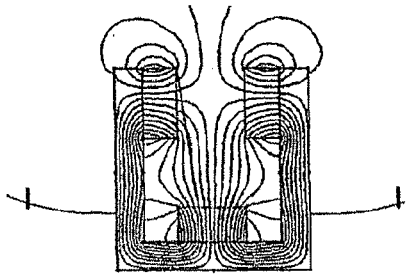
FIG. 14 is a cross sectional view and the magnetic flux behavior of the motor system of an electro-dynamic planar transducer having an opening angle of 90 degrees and a aperture width of 5 mm.
Figure 15:
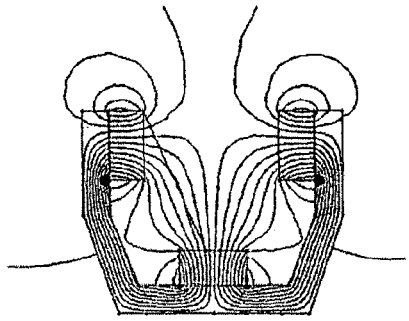
FIG. 15 is a cross sectional view and the magnetic flux behavior of the motor system of an electro-dynamic planar transducer having an opening angle of 90 degrees and a aperture width of 10 mm.

FIG. 11 is a cross sectional view of a known electro-dynamic planar loudspeaker (EDPL) and the flux behavior of the loudspeaker. FIG. 12 illustrates the magnetic flux behavior of an electro-dynamic planar transducer having a motor angle of 60 degrees and a aperture width of 15 mm while FIG. 13, FIG. 14 and FIG. 15 relate to transducers having a motor angle of 75 degrees and a aperture width of 10 mm, a motor angle of 90 degrees and a aperture width of 5 mm, and a motor angle of 90 degrees and a aperture width of 10 mm, respectively.

Figure 16:
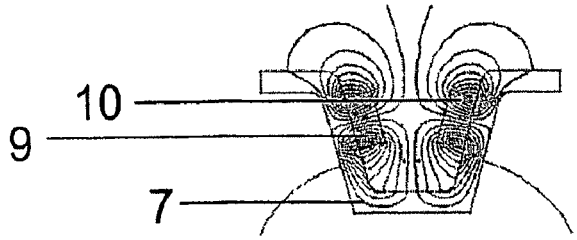
FIG. 16 is a cross sectional view and the magnetic flux behavior of the motor system of an electro-dynamic planar transducer having only two magnets.

FIG. 16 is a cross sectional view and the magnetic flux behavior of an electro-dynamic planar transducer having only the two magnets 9 and 10 in contrast to the exemplary transducers illustrated above. The magnets 9 and 10 of FIG. 16 are attached to the frame 7 such that they are adjacent to positions between the upper ends and the lower end of the diaphragm (not shown). Accordingly, the voice coil structure is arranged in positions other than this position. Preferably, the frame is made from soft-magnetic material such as for example steel or the like.

Figure 17:
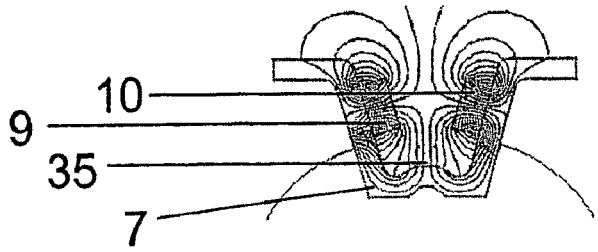
FIG. 17 is a cross sectional view and the magnetic flux behavior of the motor system of an electro-dynamic planar transducer having only two magnets and a frame comprising a flux focusing design at its lower end.

The electro-dynamic planar transducer of FIG. 17 is similar to the one shown in FIG. 16. However, the transducer of FIG. 17 comprises an upwardly directed curving at its lower end forming a flux focusing element 35. Again, the voice coil structure may be arranged in positions other than the position adjacent to the magnets and the frame may be made from soft-magnetic material.

Figure 18:
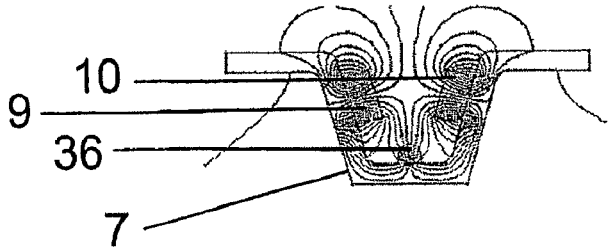
FIG. 18 is a cross sectional view and the magnetic flux behavior of the motor system of an electro-dynamic planar transducer having only two magnets and a flux focusing element at the lower end of the frame.

In FIG. 18, alternatively a flux focusing element 36 at the lower end of the frame is arranged separately from and attached to the frame 7 at the lower end of the frame 7.

Figure 19:
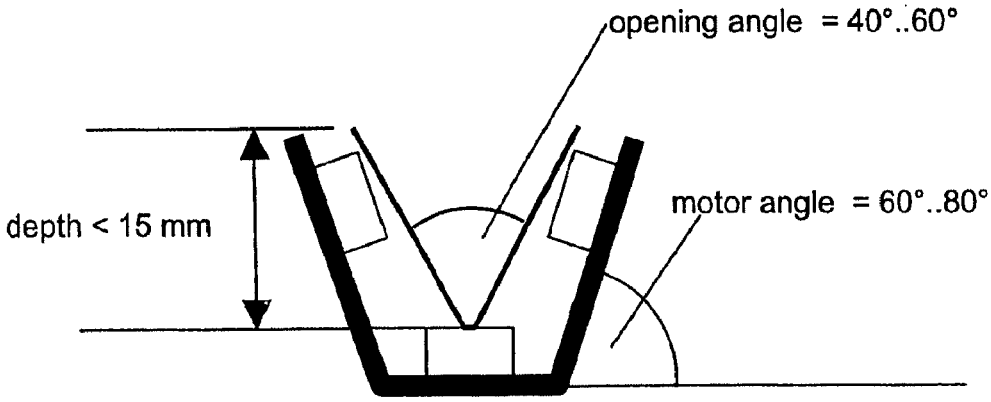
FIG. 19 is a cross sectional view of the motor system of an electro-dynamic planar transducer with three magnets illustrating typical ranges for depth, opening angle and motor angle.

FIG. 19 is a cross sectional view of an electro-dynamic planar transducer with three magnets illustrating typical ranges for depth, opening angle, and motor angle such as the depth is less than 15 mm, the motor is between 60 and 80 degrees, and the opening angle is between 40 and 60 degrees.

The present invention makes use of the advantages of the EDPL principle for an efficient tweeter. However, conventional EDPLs have a large radiating surface and, therefore, a highly directional behavior. The present invention overcomes this drawback by reducing the acoustic aperture due to folding the membrane to a generally V-shaped arrangement. The magnetic flux density tangential to membrane and the homogeneity of field perpendicular to membrane may be increased by specially designed motor systems to compensate for efficiency loss due to smaller membrane area. Flux density may be further increased by using magnets with opposing fields.

Although various examples to realize the invention have been disclosed, it will be apparent to those skilled in the art that various changes and modifications can be made which will achieve some of the advantages of the invention without departing from the spirit and scope of the invention. It will be obvious to those reasonably skilled in the art that other components performing the same functions may be suitably substituted. Such modifications to the inventive concept are intended to be covered by the appended claims.

What is claimed is:

1. An electro-acoustic transducer, comprising:

a diaphragm comprising a folded or curved sheet of film material, the diaphragm further comprising two upper ends that extend from a lower end separated by an angle less than ninety degrees, an inner surface, and an outer surface;

a frame for supporting the diaphragm at the two upper ends of the diaphragm;

a voice coil comprising a structured conductive layer arranged on at least one of the inner or outer surfaces of the diaphragm; and a first permanent magnet attached to the frame adjacent to a first of the two upper ends of the diaphragm, and a second permanent magnet attached to the frame adjacent to a second of the two upper ends of the diaphragm.

2. The electro-acoustic transducer of claim 1, comprising a third magnet arranged adjacent to the lower end of the diaphragm.

3. The electro-acoustic transducer of claim 1, where the conductive layer is arranged on the diaphragm substantially in positions non-adjacent to the magnets.

4. The electro-acoustic transducer of claim 1, where the frame comprises an external radius supporting the diaphragm at its two upper ends.

5. The electro-acoustic transducer of claim 3, where the diaphragm is tensioned between the two upper ends and the lower end.

6. The electro-acoustic transducer of claim 3, further comprising holding clamps for clamping the diaphragm at the two upper ends and/or the lower end.

7. The electro-acoustic transducer of claim 6, where at least one of the clamps is elastic or elastically clamped.

8. The electro-acoustic transducer of claim 3, further comprising a sound wave guiding element arranged in a position adjacent to the inner surface of the diaphragm.

9. The electro-acoustic transducer of claim 3, further comprising a phase plug for clamping the diaphragm at the lower end and guiding sound, the phase plug having a sound wave guiding shape and being arranged in a position adjacent to the inner surface of the diaphragm.

10. The electro-acoustic transducer of claim 1, where the permanent magnets are arranged in a position between the frame and the outer surface of the diaphragm.

11. The electro-acoustic transducer of claim 1, where the frame has a cup-like shape forming a closed volume in connection with the diaphragm.

12. The electro-acoustic transducer of claim 10, where the frame has a cup-like shape comprising openings.

13. The electro-acoustic transducer of claim 12, where the openings are covered by an acoustically damping layer.

14. The electro-acoustic transducer of claim 3, where the lower end of the diaphragm has two edges.

15. The electro-acoustic transducer of claim 1, further comprising at least one ferromagnetic element for focusing magnetic flux arranged adjacent to the lower end of the diaphragm.

16. The electro-acoustic transducer of claim 15, where the ferromagnetic element is a soft-magnetic rod.

17. The electro-acoustic transducer of claim 15, where the permanent magnets are neodymium magnets.

18. The electro-acoustic transducer of claim 17, where the film material comprises polyethylene or polyethylene-naphthalate or polyimide.

19. The electro-acoustic transducer of claim 18, where the upper ends of the diaphragm are fixed to the frame by adhesive.

20. The electro-acoustic transducer of claim 18, where the structured conductive layer comprises aluminum.

21. The electro-acoustic transducer of claim 18, where the structured conductive layer is arranged in a meandering pattern.

22. The electro-acoustic transducer of claim 18, where the structured conductive layer is arranged in a butterfly pattern.

23. The electro-acoustic transducer of claim 1, where each surface of the diaphragm comprises a structured conductive layer.

24. The electro-acoustic transducer of claim 18, where the magnets are arranged such that they generate opposing magnet field.

25. The electro-acoustic transducer of claim 24, where the magnets are arranged to provide a motor angle of between 70 and 80 degrees.

26. The electro-acoustic transducer of claim 25, where the motor angle is approximately 75 degrees.

27. An electro-acoustic transducer, comprising:

a frame that includes a base, a first sidewall having a first sidewall distal end and a second sidewall having a second sidewall distal end, where the first and second sidewalls are in contact with the base at their proximal ends and extend from the base separated by an angle of less than ninety degrees;

a first magnet attached to the first sidewall distal end;

a second magnet attached to the second sidewall distal end;

a third magnet located on the base between the first and second sidewalls;

a diaphragm that includes a curved/folded sheet of film material that is supported by the frame at the first and second sidewall distal ends and is separated from the base by the third magnet, where a voice coil is located on an inner surface of the diaphragm between the first and third magnets.

28. The electro-acoustic transducer of claim 27, where the film material is selected from the group comprising polyethylene, polyethylene-naphthalate and polyimide.

29. The electro-acoustic transducer of claim 28, further comprising a sound wave guiding element that is connected to a pulling bolt that extends from the base and through an opening in the diaphragm, where the sound wave guiding element and the pulling bolt cooperate to tension the diaphragm by pulling the diaphragm towards the third magnet.

30. The electro-acoustic transducer of claim 29, where a first portion of the voice coil is located on the inner surface of the diaphragm between the first and third magnets and a second portion of the voice coil is located on the inner surface of the diaphragm between the second and third magnets.

31. The electro-acoustic transducer of claim 30, where the frame is substantially V-shaped.

32. The electro-acoustic transducer of claim 27, where the frame is substantially V-shaped.

33. The electro-acoustic transducer of claim 27, where the frame comprises a plurality of through holes in the base and in the first and second sidewalls, and an exterior surface of the base is covered with acoustic damping material and an exterior surface of a length of the first sidewall is covered with the acoustic damping material between the base and the location of the first magnet.

34. An electro-acoustic transducer, comprising:

a frame that includes a base, a first sidewall having a first distal end and a second sidewall having a second distal end, where the first and second sidewalls contact the base at their proximal ends and extend from the base separated by an angle less than ninety degrees;

a first magnet attached to the frame towards the first distal end;

a second magnet attached to the frame towards the second distal end;

a third magnet located on the base between the first and second sidewalls;

a diaphragm that includes a sheet of film material supported by the frame at the first and second distal ends and is separated from the base by the third magnet, where a voice coil is located on the diaphragm between the first and third magnets.

35. The electro-acoustic transducer of claim 34, where the base is planar and the first sidewall extends from a first longitudinal end of the planar base and the second sidewall extends from a second longitudinal end of the planar base.

36. The electro-acoustic transducer of claim 35, where a second portion of the voice coil is located between the second and third magnets.

37. The electro-acoustic transducer of claim 36, where the diaphragm extends from the first distal end towards the base and forms an edge proximate to the base.

* * * * *